US005625174A

United States Patent [19]

Ito et al.

[11] Patent Number: 5,625,174

[45] Date of Patent: Apr. 29, 1997

[54] LINEAR MOTOR ELEVATOR

[75] Inventors: Hideki Ito; Makoto Yoshihara, both of Kawasaki, Japan

[73] Assignee: Otis Elevator Company, Farmington, Conn.

[21] Appl. No.: 349,165

[22] Filed: Dec. 2, 1994

[30] Foreign Application Priority Data

Dec. 17, 1993 [JP] Japan ..... 5-317224

[51] Int. Cl.[6] ..... B66B 1/06; B66B 7/08; B66B 9/02

[52] U.S. Cl. ..... 187/289; 310/10; 187/411; 187/252; 187/250

[58] Field of Search ..... 187/289, 411, 187/412, 251, 252, 414, 283, 269, 280, 284, 902; 310/10, 12, 13

[56] References Cited

U.S. PATENT DOCUMENTS

| | | | |
|---|---|---|---|
| 2,905,374 | 9/1959 | Brumby | 187/17 |
| 5,090,516 | 2/1992 | Grinaski et al. | 187/112 |
| 5,183,980 | 2/1993 | Okuma et al. | 187/112 |
| 5,203,403 | 4/1993 | Grinaski et al. | 187/17 |
| 5,226,507 | 7/1993 | Kawarasaki | 187/20 |
| 5,235,226 | 8/1993 | Olsen et al. | 310/12 |
| 5,299,662 | 4/1994 | Reddy et al. | 187/94 |
| 5,300,737 | 4/1994 | Nakanishi | 187/112 |

FOREIGN PATENT DOCUMENTS

| | | | |
|---|---|---|---|
| 400994 | 12/1990 | European Pat. Off. | 187/289 |
| 3-95083 | 4/1991 | Japan | 187/289 |
| 4-39286 | 2/1992 | Japan | 187/289 |
| 4-80188 | 3/1992 | Japan | 187/902 |
| 4-223985 | 8/1992 | Japan | 187/902 |

*Primary Examiner*—Robert Nappi

[57] ABSTRACT

A linear motor elevator includes a linear motor that is permitted motion within the hoistway. The linear motor is mounted in a manner permitting motion of the entire linear motor, including stator, through the hoistway. As a result, the length of the hoistway and the run of the elevator may extend beyond the length of the stator. In a particular embodiment, the linear motor is connected to a car in a configuration permitting the car to travel at approximately twice the speed of the linear motor within the hoistway. The moving element of the linear motor is connected to the car to permit the car and moving element to travel at the same speed relative to the hoistway. As a result, the moving element moves relative to the stator at half the speed of the car speed and the height of the hoistway may be approximately double the height of the stator.

12 Claims, 4 Drawing Sheets

LINEAR MOTOR ELEVATOR

TECHNICAL FIELD

This invention relates to a linear motor type elevator.

BACKGROUND OF THE INVENTION

A conventional linear motor type elevator includes a car arranged to be able move vertically in a hoistway and a counterweight for balancing the car. The car is moved vertically by a linear motor installed in the hoistway. The linear motor includes a moving element and a stator, and motion of the car is the result of relative motion between the moving element and the stator. Typically, the moving element is integral to the counterweight and includes a through-hole. A column-shaped stator extends through the through-hole. One end of a rope is fixed to the moving element, and the other end is attached to the car via a sheave. If a drive current is supplied to the linear motor, a magnetic force is generated between the stator and the moving element, and the moving element moves vertically with respect to the stator. As a result, the car is moved vertically.

In this conventional linear motor type elevator, only the upper and lower ends of the column-shaped stator are fixed and supported on the building. The middle portion is not supported at all to avoid interference with the moving element. This configuration permits a relationship in which the moving element moves along the extent of the stator. For this reason, the length of the stator has a limited length of about thirty meters. As a result of this limitation, the conventional linear motor cannot be used as a drive source in an elevator for a building requiring longer runs.

Another consideration with linear motor elevators is the output of the linear motor required to drive the elevator. It is desirable to minimize the output required to drive the elevator, thereby minimizing the size, weight and cost of the linear motor elevator.

SUMMARY OF THE INVENTION

An object of this invention is to extend the effective run length of a linear motor type elevator.

Another object is to minimize the required output of the linear motor of a linear motor type elevator.

According to the present invention, a linear motor elevator includes a linear motor that is permitted to move relative to the hoistway.

According further to the present invention, the linear motor is engaged with the elevator car via a roping system permitting the linear motor to move within the hoistway at half the speed of the elevator car. The linear motor includes an integral sheave that is engaged with a rope fixed to the hoistway and to the car. The linear motor further includes a stator extending through the linear motor and a moving element engaged with the stator. The moving element is connected to the car by another rope such that it moves within the hoistway at the same speed as and in an opposite direction to the car. Since the linear motor, and thereby the stator, moves relative to the car via the rope and integral sheave, the stator moves within the hoistway at half the speed of the car.

When the car is positioned on the uppermost floor, the entire linear motor is positioned at the lower half of the hoistway, and the moving element is positioned at the lower end of the stator. When a drive current is supplied to the linear motor in this position, a magnetic force is generated between the stator and the moving element, and the moving element moves upward with respect to the stator. At the same time, the entire linear motor also moves upward, and the car is moved downward. When the car arrives at the lowest floor, the entire linear motor is positioned at the upper half of the hoistway, and the moving element is positioned at the upper end of the stator. As a result, the car can move twice the length with respect to the hoistway that the moving element moves with respect to the stator.

A principle feature of the present invention is that the entire linear motor moves relative to the hoistway. Another feature is the sheave installed on the linear motor and the rope extending from a fixed point, through the sheave for the linear motor and to the car. A primary advantage of these features is that the height of the channel can be doubled with respect to the length of the stator of the linear motor. Another advantage is that since the moving speed of the moving element with respect to the stator is half of the moving speed of the car with respect to the hoistway, the required output of the linear motor can be reduced by half, compared with a conventional linear motor elevator.

BEST MODE FOR CARRYING OUT THE INVENTION

Figure 1:
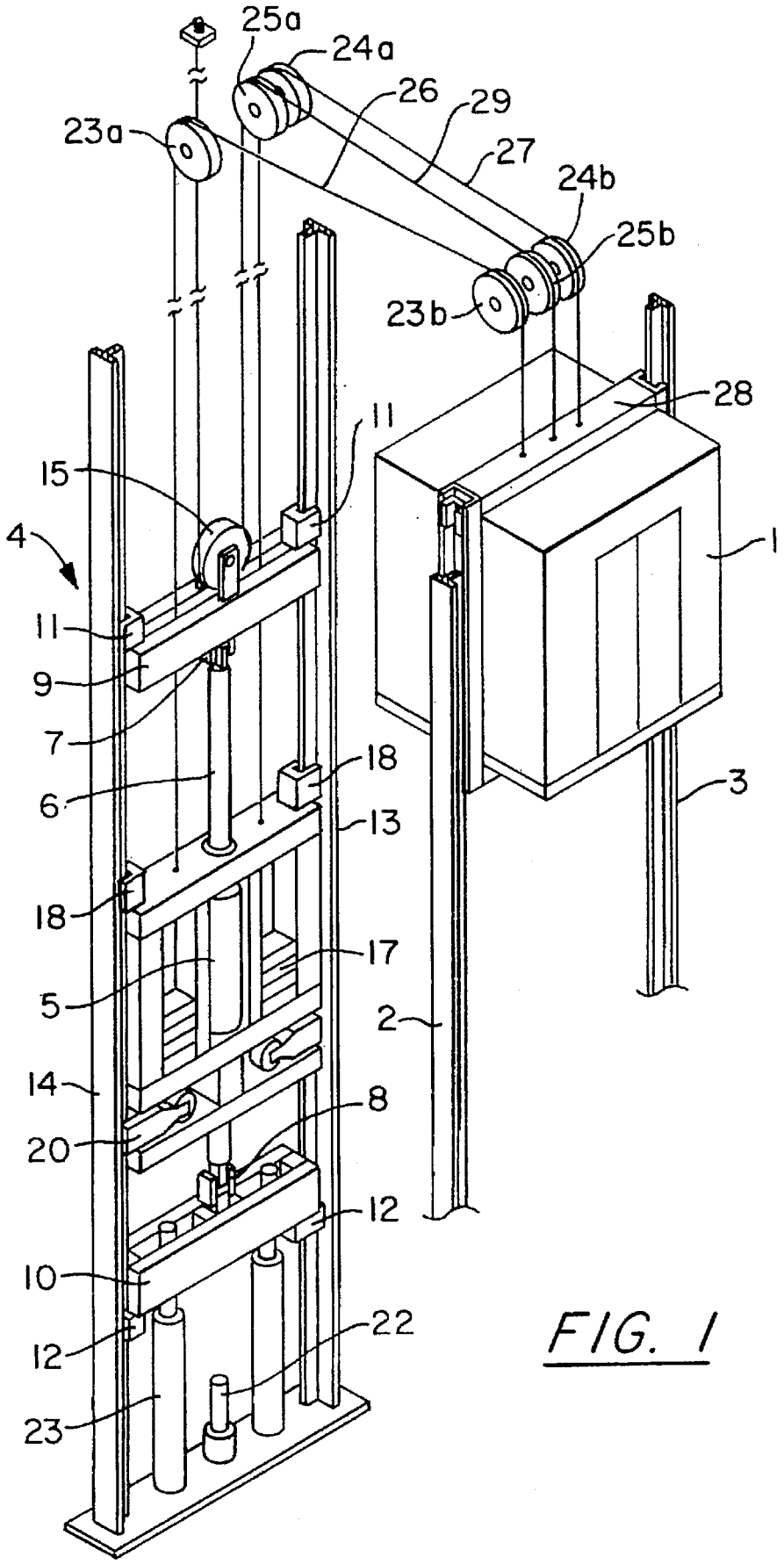
FIG. 1 is an oblique view which shows an application example of the linear motor elevator of this invention.

A linear motor elevator is illustrated in FIG. 1. The linear motor elevator includes a car 1 arranged to be able to move vertically in a hoistway. At both sides of the car 1, guide rails 2 and 3 are arranged for guiding it in the vertical direction. The car 1 is driven by a linear motor 4 installed adjacent to the car 1 in the hoistway.

Figure 2:
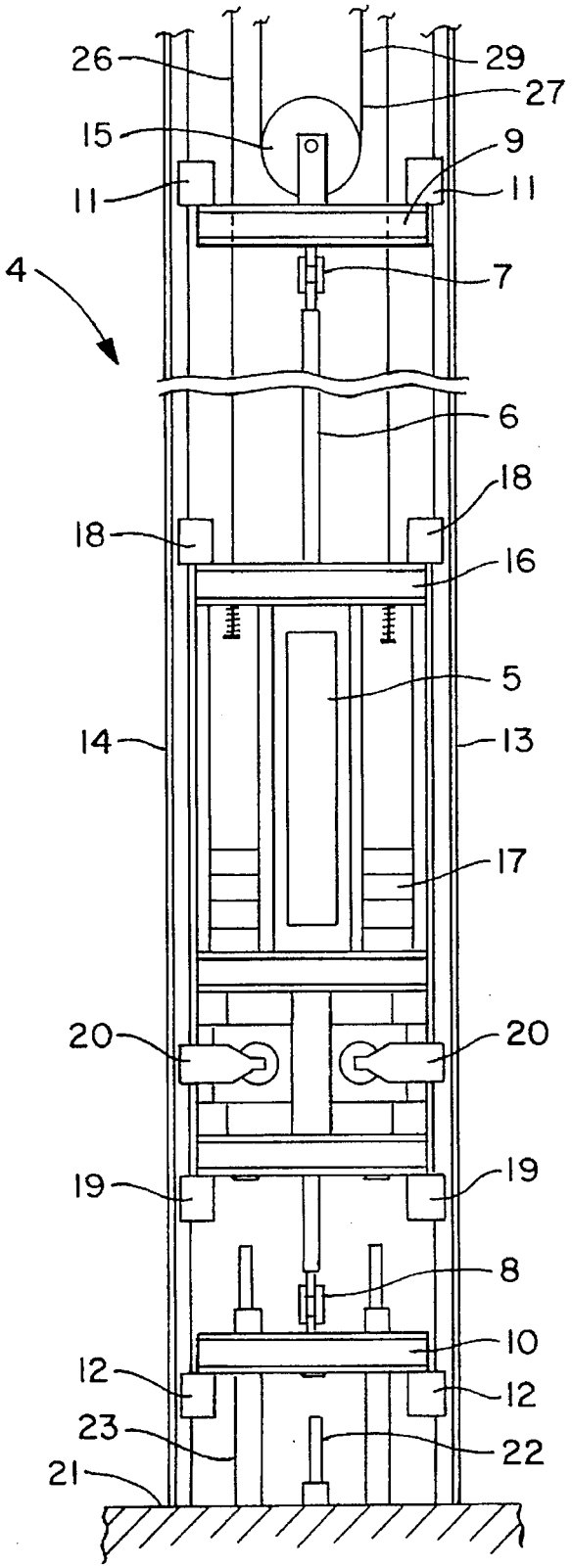
FIG. 2 is a plan view of the linear motor.

The linear motor 4, as shown in FIG. 2, includes a moving element 5 and a stator 6. The moving element 5 is a primary conductor in an approximately cylindrical shape with a through-hole. The stator 6 is a column-shaped secondary conductor which penetrates into the moving element 5. Although configurations other than a column-shaped secondary conductor and a cylindrical moving element may be used, this configuration will be used to illustrate the invention.

The upper and lower two ends of the stator 6 are connected to supporting members 9 and 10 via pin connectors 7 and 8, respectively. At the left and right two ends of the supporting members 9 and 10, guide shoes 11 and 12 are connected, and the guide shoes 11 and 12 are coupled to be freely slid on the guide rails 13 and 14 installed at both sides of the stator 5. An integral sheave 15 for the linear motor is installed at the supporting member 9 so as to be freely rotated.

The moving element 5 is installed and supported at a frame 16 that includes a counterweight 17. At the frame 16, guide shoes 18 and 19 are installed, and these guide shoes 18 and 19 are slidingly engaged with the guide rails 13 and 14. Also, at the frame 16, a brake 20 for emergency stop is also installed. In a pit room 21 at the lower portion of the hoistway, buffers 22 and 23 for buffering against collision of the stator 6 and the moving element 5 are installed.

Figure 3:
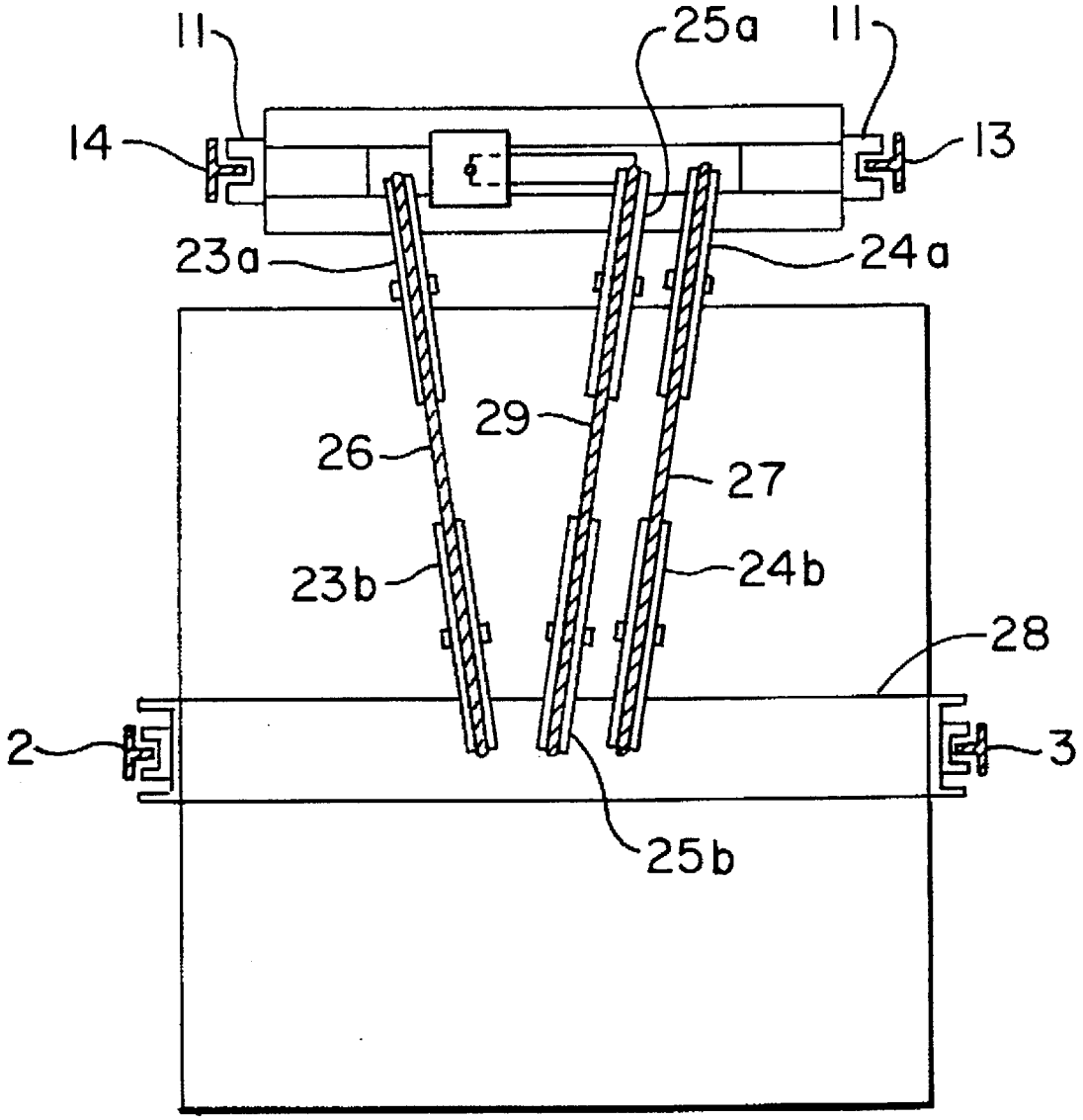
FIG. 3 is a plan view of the elevator.

At the upper portion of the hoistway, as shown in FIG. 3, a plurality of overhead sheaves 23*a*, 23*b*, 24*a*, 24*b*, 25*a*, and 25*b* are supported at an overhead beam (not shown in the figure) so as to be freely rotatable, and are engaged with a plurality of ropes 26, 27, 29. The first ropes 26 and 27 are engaged with the first overhead sheaves 23*a*, 23*b*, and 24*a* and 24*b*. One end of each of the first ropes 26, 27 is fixed onto the frame 16 and the other end is fixed to the car frame 28 installed on the car 11. The first ropes 26,27 pass through and are not fixed to the upper supporting member 9 of the stator 6. The second rope 29 is engaged with the second overhead sheaves 25*a* and 25*b*. One end of the second rope 27 is fixed to the overhead beam of the hoistway and the other end is fixed to the car frame 28. The second rope 29 is engaged with the integral sheave 15 of the stator 6.

During operation, as the elevator moves within the hoistway, the moving element 5 moves along the stator 6 and the entire linear motor 4, including the stator 6, moves relative to the hoistway. The roping arrangement between the linear motor and the car results in the linear motor moving, relative to the hoistway, at half the speed of the car and in the opposite direction. The roping arrangement between the moving element and the car results in the moving element and the car moving, relative to the hoistway, at the same speed but in the opposite direction. As a result of the relative motions between the linear motor and the car, the relative motion between the moving element and the stator is also at half the speed of the car within the hoistway. In addition, the length of the stator required is approximately half of the height of the hoistway since the stator moves within the hoistway.

Figure 4:
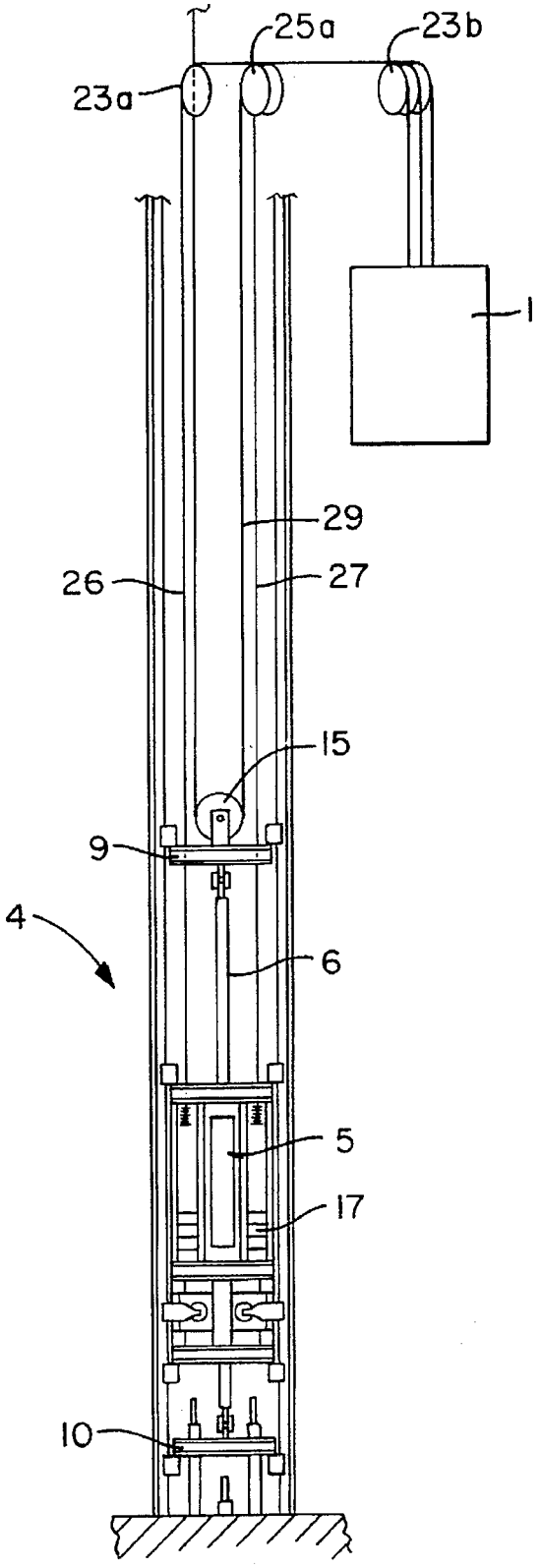
FIG. 4 shows the operation of the elevator.
Figure 5:
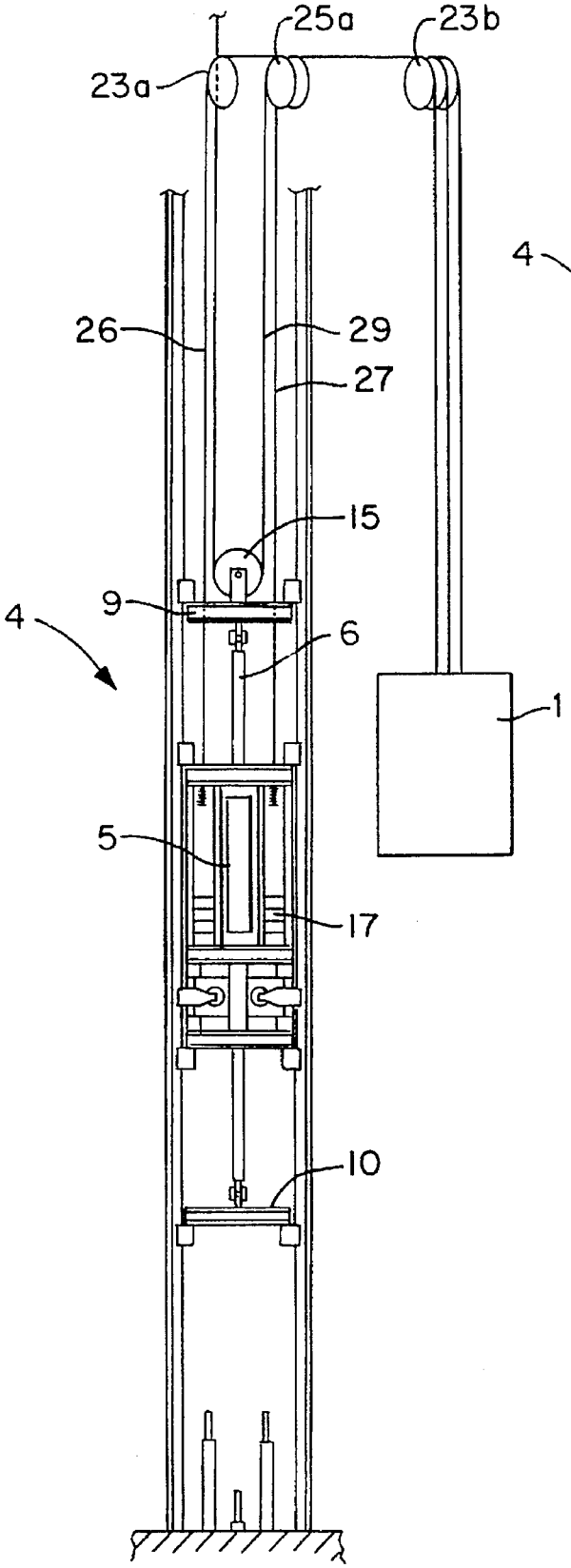
FIG. 5 shows the operation of the elevator.
Figure 6:
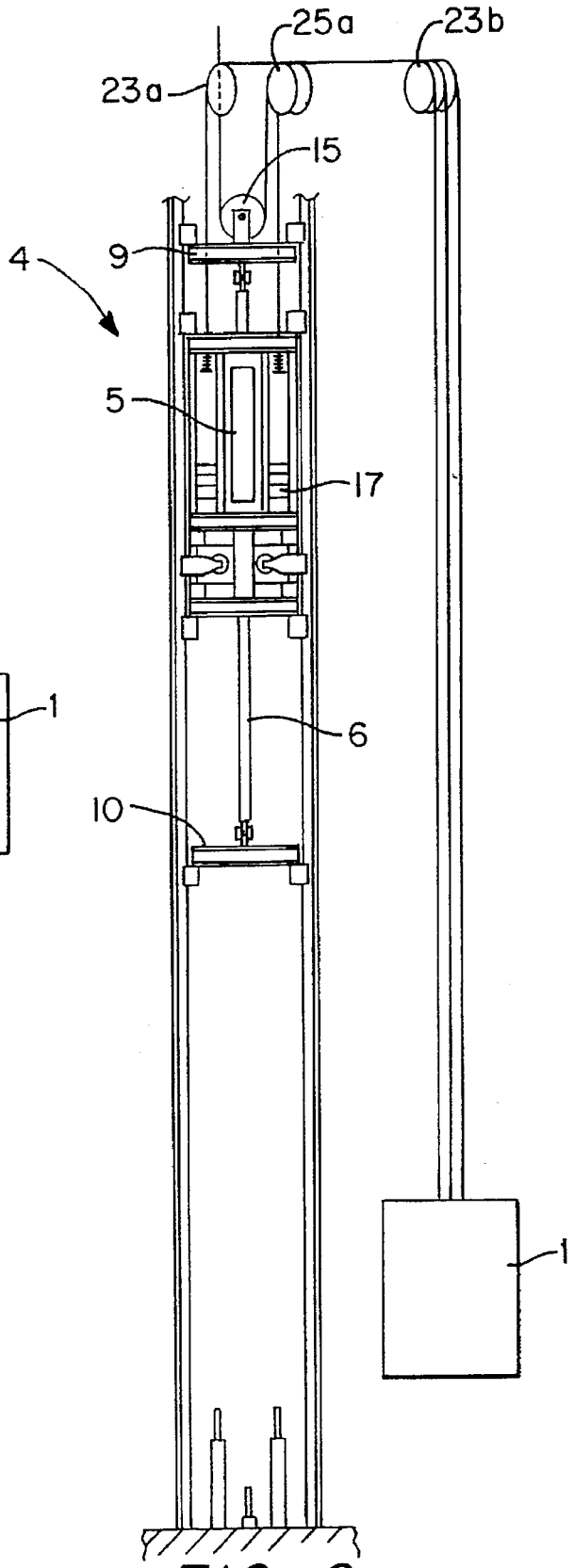
FIG. 6 shows the operation of the elevator.

A more detailed explanation of the operation of the linear motor elevator is shown in FIGS. 4–6.

As shown in FIG. 4, when the car 1 is positioned at the upper end of the hoistway, the entire linear motor 4 lies at the lower end of the hoistway, and the moving element lies at a lower position with respect to the stator 6. Here, when a drive current is supplied to the linear motor 4, as shown in FIG. 5, a magnetic force is generated between the stator 6 and the moving element 5, and the moving element 5 moves upward with respect to the stator 6. At the same time, the entire linear motor 4 moves upward, and the car 1 is moved downward within the hoistway. The moving speed of the moving element 5 with respect to the stator 6 is about half of the moving speed of the car 1 within the hoistway. For this reason, the required output of the linear motor 4 is about half that of a conventional linear motor carrying the same car loading.

As shown in FIG. 6, when the car 1 arrives at the lower end of the hoistway, the entire linear motor 4 positions at the upper end of the hoistway, and the moving element 5 lies at a higher position with respect to the stator 6. Thus, the car 1 can move twice as far with respect to length as the moving element 5 moves with respect to the stator 6. In other words, the ascent and descent stroke of the car 1 can be approximately doubled with respect to the length of the stator 6. In order for the car 1 to move from the lowest floor to the highest floor, the above-described operations should be reversed.

The linear motor elevator illustrated in FIGS. 1–6 and described above has a particular roping arrangement permitting the linear motor to travel at half the speed of the car. It should be obvious to one skilled in the art that other roping arrangements may be used to provide different relative speeds between the linear motor and car, and between the moving element and car.

Although the invention has been shown and described with respect to an exemplary embodiment thereof, it should be understood by those skilled in the art that various changes, omissions, and additions may be made thereto, without departing from the spirit and scope of the invention.

We claim:

1. A linear motor elevator disposed within a hoistway, the linear motor elevator including:

a car disposed for motion within the hoistway; and a linear motor engaged with the car to provide motion of the car, the linear motor including a primary and a secondary element, wherein both the primary and the secondary element move within the hoistway, and wherein the motion of the primary and secondary elements is relative to, and proportional to, the motion of the car.

2. The linear motor elevator according to claim 1, further including a rope fixed to the hoistway and to the car, wherein the linear motor includes an integral sheave, and wherein the rope is engaged with the sheave.

3. The linear motor elevator according to claim 1 wherein a rope extends from the primary element to the car.

4. The linear motor elevator according to claim 3, wherein the hoistway includes a pair of guide rails, wherein the linear motor further includes upper and lower supporting members with the secondary extending therebetween, and a plurality of guide shoes disposed on the supporting members and engaged with the guide rails, and wherein the primary element includes a frame and guide shoes disposed on the frame and engaged with the guide rails, such that the primary element may move relative to the supporting members.

5. The linear motor elevator according to claim 2 wherein another rope extends from the primary element to the car.

6. The linear motor elevator according to claim 2, wherein the hoistway includes a pair of guide rails, wherein the linear motor further includes upper and lower supporting members with the secondary element extending therebetween, and a plurality of guide shoes disposed on the supporting members and engaged with the guide rails, and wherein the primary element includes a frame and guide shoes disposed on the frame and engaged with the guide rails, such that the primary element may move relative to the supporting members.

7. The linear motor elevator according to claim 3, wherein the hoistway includes a pair of guide rails, wherein the linear motor further includes upper and lower supporting members with the secondary element extending therebetween, and a plurality of guide shoes disposed on the supporting members and engaged with the guide rails, and wherein the primary element includes a frame and guide shoes disposed on the frame and engaged with the guide rails, such that the primary element may move relative to the supporting members.

8. The linear motor elevator according to claim 5, wherein the hoistway includes a pair of guide rails, wherein the linear motor further includes upper and lower supporting members with the secondary element extending therebetween, and a plurality of guide shoes disposed on the supporting members and engaged with the guide rails, and wherein the primary element includes a frame and guide shoes disposed on the frame and engaged with the guide rails, such that the primary element may move relative to the supporting members.

9. The linear motor elevator according to claim 1, further including a first rope extending between the car and the primary element and a second rope extending between the car and the secondary element, wherein the car and secondary element are roped in a N:1 relationship, wherein N is an even integer, and wherein the car and primary element are roped in a N':1 relationship, wherein N is a multiple of N'.

10. The linear motor elevator according to claim 4, further including a first rope extending between the car and the primary element and a second rope extending between the car and the secondary element, wherein the car and secondary element are roped in a N:1 relationship, wherein N is an even integer, and wherein the car and primary element are roped in a N':1 relationship, wherein N is a multiple of N'.

11. The linear motor elevator according to claim 9, wherein N'=1 and N=2.

12. The linear motor elevator according to claim 10, wherein N'=1 and N=2.

* * * * *